US008747038B2

(12) United States Patent
Baughey et al.

(10) Patent No.: US 8,747,038 B2
(45) Date of Patent: Jun. 10, 2014

(54) PACKAGING CLIP

(75) Inventors: Mark L. Baughey, Hartford City, IN (US); Daniel R. Baughey, Hartford City, IN (US)

(73) Assignee: HP Products Co., Hartford City, IN (US)

( * ) Notice: Subject to any disclaimer, the term of this patent is extended or adjusted under 35 U.S.C. 154(b) by 0 days.

(21) Appl. No.: 13/484,153

(22) Filed: May 30, 2012

(65) Prior Publication Data

US 2013/0000086 A1 Jan. 3, 2013

Related U.S. Application Data

(63) Continuation of application No. 12/381,909, filed on Mar. 18, 2009, now abandoned.

(60) Provisional application No. 61/069,798, filed on Mar. 18, 2008.

(51) Int. Cl.
*B60P 7/00* (2006.01)

(52) U.S. Cl.
USPC ..... 410/155; 410/41; 410/120

(58) Field of Classification Search
USPC ..... 410/31, 32, 39, 40, 41, 99, 120, 155; 206/453, 586, 593; 248/217.3, 345.1; 24/545, 546, 563, 570; 52/579, 716.8, 52/800.12

See application file for complete search history.

(56) References Cited

U.S. PATENT DOCUMENTS 6,158,931 A * 12/2000 Savard ..... 410/40

* cited by examiner

*Primary Examiner* — Stephen Gordon
(74) *Attorney, Agent, or Firm* — Krieg DeVault LLP; Clifford W. Browning

(57) ABSTRACT

A packaging clip having an end tab that aids in the quick removal of the packaging clip from an end board without damaging either the clip or the end board. The packaging clip can be placed to receive a single end board or to receive adjoining end boards. Each packaging clip is capable of gripping the end board received therein in the event that the fit is too loose. Packaging clips are used for receiving and stabilizing the placement of multiple end boards on a pallet and for the alignment of the ends boards with each other.

1 Claim, 2 Drawing Sheets

PACKAGING CLIP

CROSS-REFERENCE TO RELATED APPLICATIONS

This application is a continuation of U.S. patent application Ser. No. 12/381,909, filed on Mar. 18, 2009, now abandoned, which claims priority benefit of U.S. Provisional Patent Application Ser. No. 61/069,798, filed Mar. 18, 2008, each of which are incorporated by reference in its entirety.

BACKGROUND OF THE INVENTION

The present invention pertains to packaging and palletized packages, generally, and more particularly to a novel removable and recyclable packaging clip used in such packaging and packages. The recycling of packaging clips will provide cost savings to the packaging industry, and more importantly, will provide an environmental benefit.

Packaging clips have been used in the textile industry for packing large rolls of textiles, such as paper or plastic film. Use of packaging clips is a safer and more secure way to load and ship a pallet of rolls of textiles for shipment to customers when used in connection with rectangular or square rigid end boards connected to the ends of each roll with roll plugs. The flat edges of end boards prevent the rolls of textiles from rolling as they sit on a flat surface. By using end boards, rolls of textiles may be elevated from the pallet, spaced apart from other rolls, and more securely stacked on a pallet than can be accomplished by attempting to place rolls directly on a pallet without end boards. Without end boards, rolls are susceptible to becoming engaged with each other and/or becoming damaged or rolling off the pallet, thus requiring greater attention and effort to ensure secure placement on the pallet. Packaging clips are used to secure end boards to a pallet. U.S. Pat. No. 6,592,309 to Baughey discloses and claims an alternating U-channel packaging clip used in such a packaging system. The disclosure of this patent is hereby incorporated by reference, in its entirety, into this specification.

In general, upstanding rectangular or square end boards are secured to the ends of rolls of textiles by roll plugs, and multiple rolls are stacked on a pallet in a spaced relationship. End boards keep the rolls separated and connected to the pallet. In order to stabilize the special relation of end boards on the pallet, U-channel packaging clips are secured to the pallet and end board edges are inserted into the clips, which then act as rails to limit the lateral movement in two directions. The remaining directions of lateral movement are limited by polymeric or metal banding securing the rolls to the pallet.

Packing clips now commonly used for stacking rolls of textiles are removed after use so the end boards may be recycled for re-use. The recycling of the packaging clips now commonly has been limited by their designs, an example of which is shown in Prior Art FIGS. 7*a* and 7*b*, which has increased the time-consuming removal process and has tended to cause damage to the end boards. Thus, it is highly desirable to provide a new packaging clip design and method of use that will permit easier recycling of the most commonly used packaging clips and that also will have environmental benefits, energy savings, and produce waste reduction and raw material conservation in recycling of packaging clips.

SUMMARY OF THE INVENTION

It is therefore an object of the invention to provide a new and improved design for a packaging clip that enables its easier recycling. Since packaging clips vary in widths and methods of being secured to end boards, the specific design must be universal for all industrial and commercial uses, and must provide a fast method of removing the packaging clip from end boards without destroying the packaging clip or the end boards. The novel design for a recyclable packaging clip of the present invention allows the packaging clip to be put in to use, taken off, and recycled all without damage to the either the packaging clip or end boards.

Novel end tabs of the packaging clips of the present invention replace the side tabs present on the most commonly used packaging clips. The novel end tabs of the present invention will enable recyclers and end users to remove packaging clips by providing a space between the packaging clip and end board to engage a tool under the tab to pry the packaging clip free from an end board, thereby providing a ready means for reuse of both the packaging clips and the end boards without damaging either. Because the novel end tabs of the packaging clip of the present invention will facilitate ease of removal of the packaging clip from an end board, packaging clip and end board recycling will be promoted, which will provide environmental benefits, energy savings, waste reduction and raw material conservation One embodiment of the present invention is a packaging clip that includes a set of novel downwardly protruding end tabs formed from end edges of the middle support of the packaging clip. The end tabs protrude downwardly from each end of the middle support to form a raised slot profile into which a wedging tool may be inserted. The raised slot profile thus enables a tool to be engaged between the packaging clip and an end board to pry the packaging clip from the end board, using the end board as the lever point for the tool.

DETAILED DESCRIPTION OF THE PREFERRED EMBODIMENTS

Figure 5:
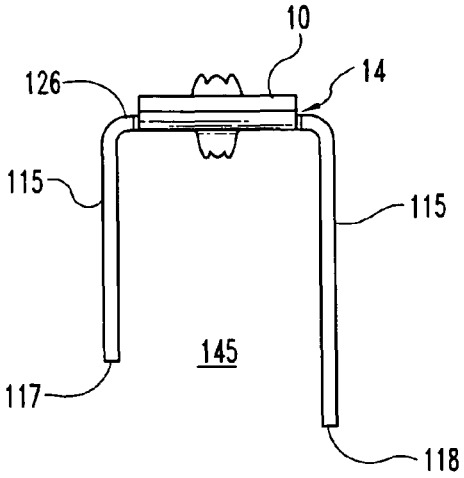
FIG. 5 is an end view of a packaging clip of the present invention showing the novel end tabs thereof.
Figure 7A:
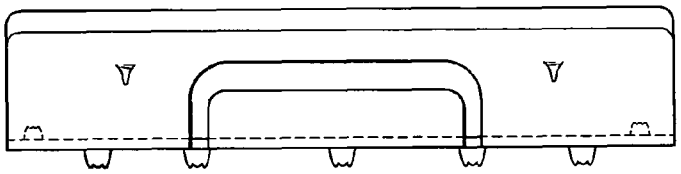
Fig. 7a (Prior Art)
FIG. 7*a* is a side view showing a packaging clip of the prior art.
Figure 7B:
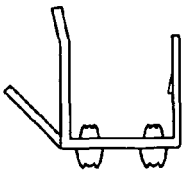
Fig. 7b (Prior Art)
FIG. 7*b* is an end view of the Prior art packaging clip of FIG. 7*a*.

Referring now to the Figures, the novel packaging clip 12 of the present invention has upstanding receiving members 115. The receiving members 115 comprise two upstanding free edges 117, 118 extending perpendicularly from a middle support 125, thereby forming a U-shaped clip 12 (FIG. 5). U-shaped receiving channel 145 is generally defined by the free edges 117, 118 of the receiving members 115 oppositely disposed from the middle support 125, into which the receiving members 115 will receive an end board (not shown). The middle support 125 has two end edges 126, 127 at opposite ends of packaging clip 12.

Figure 6:
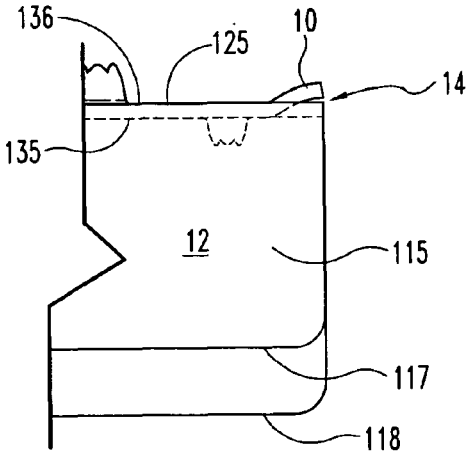
FIG. 6 is a partial side view showing a packaging clip of the present invention with the end tab detail.

Though one of the end edges of the middle support 125 is shown in FIGS. 5 and 6, both of the end edges 126, 127 of the middle support 125 have an end tab 10. The end tabs 10 are formed from the middle support 125 and protrude downwardly from the U-shaped receiving channel 145 created by the receiving members 115 and the middle support 125. The end tabs 10 can extend the width of or less than the end edges 126, 127 of the middle support 125. In one preferred embodiment to date, the end tabs 10 protrude downwardly a distance approximately equal to the thickness of the middle support 125.

In one preferred embodiment shown in FIGS. 5 and 6, the end tabs 10 are formed by deformation of the middle support 125 during the clip 10 forming process. In another preferred embodiment shown in FIGS. 1-4, the end tabs 10 are formed by cutting notches in the end edges 126, 127 of the middle support 125 followed by a forced bending process that deforms the tab portion created by the notches downwardly and away from the receiving channel 145. In yet another preferred embodiment, the cutting and forming steps can be part of a single process.

Figure 1:
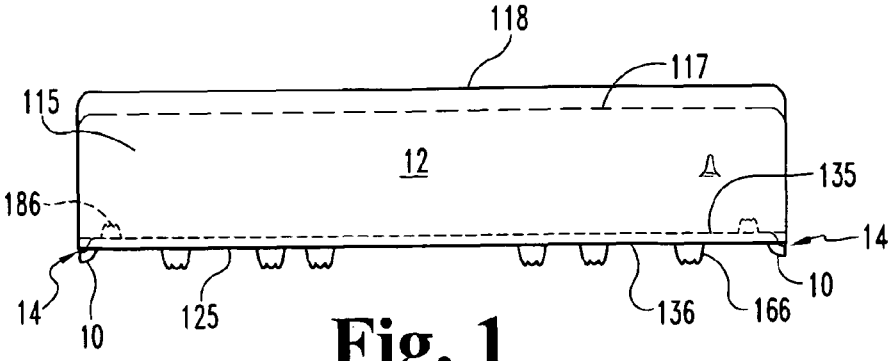
FIG. 1 is a side view of the novel packaging clip of the present invention showing the novel end tabs thereof.
Figure 2:
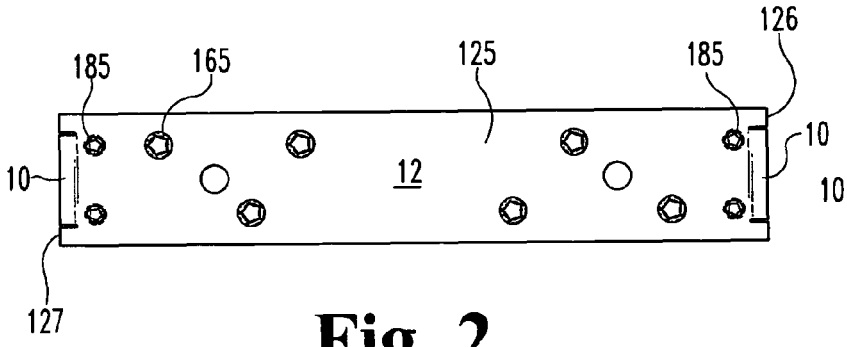
FIG. 2 is a bottom view of the packaging clip of FIG. 1.
Figure 3:
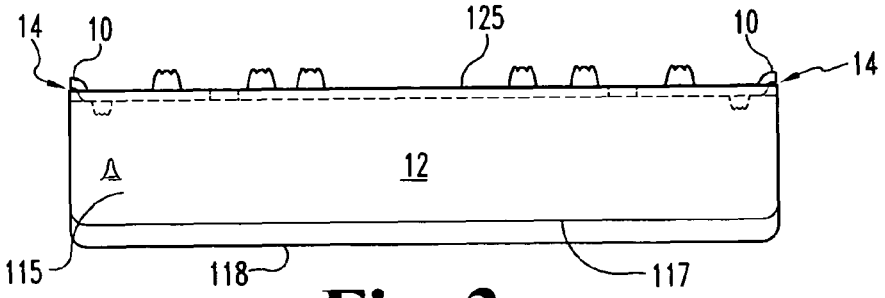
FIG. 3 is another side view of the packaging clip of FIG. 1.

As shown in FIGS. 1-3, within the middle support 125 are a number of semi-perforated punches 165. These punches 165 start on the inner surface 135 of the middle support 125 and create burrs 166 on the outer surface 136 of the middle support 125. The burrs 166 are structured to engage adjacent end boards (not shown) during stacking. In one embodiment, the burr 166 height is one-eighth of an inch. In others, the height is one-sixteenth to one-quarter of an inch. The burr 166 height could be greater than the end tab 10 height.

A second set of punches 185 and resulting burrs 186 are located in the middle support 125. These punches 185 begin on the outer surface 136 of the middle support 125 creating burrs 186 on the inner surface 135. In one preferred embodiment, the burrs 186 have an effective height of approximately one-sixteenth of an inch. The burrs 186 are structured to assist in defining a slot profile 14 between the clip 12 and an end board (not shown).

The slot profile 14 aids in allowing a wedging tool to slide between the middle support 125 of the clip 12 and an end board when the clip 12 is assembled to an end board. The tool should be allowed enough access to prevent damage to the clip 12 and an end board during removal. The tool can be something as readily available as a flat-head screwdriver, but can also be a specially designed shape and material to minimize any type of damage to the clip 12 or an end board during removal.

Figure 4:
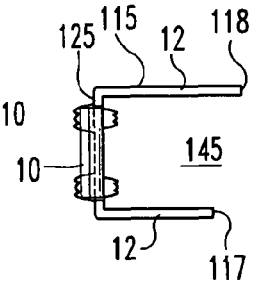
FIG. 4 is an end view of the packaging clip of FIG. 1.

In another preferred embodiment as illustrated in FIGS. 1-3, the receiving members 115 have a length of between 4 and 8 inches. In yet another preferred embodiment as illustrated in FIG. 2, the middle support 125 of the clip 12 is between ¾ of an inch and 1¼ inches in width. In still another preferred embodiment, the thickness of any portion of the material of the clip 12 is no more than ⅛ of an inch. In other preferred embodiments as illustrated in FIG. 4, the upstanding free edges 117, 118 of the receiving members 115 extend from the middle support 125 to a height between ¾ of an inch and 2 inches. In yet other preferred embodiments illustrated in FIG. 2, the end tabs 10 extend the width of the middle support 125. While for still others, the end tab 10 width is between ⅝ inch and 1¼ inch.

The packaging clip 12 is formed of one continuous piece of stamped metal. In other specific embodiments, the metal with which the clip 12 is manufactured is iron based. In yet other specific embodiments, the iron based metal is resistant to rusting. In other specific embodiments, the metal is galvanized. In yet specific embodiments, the metal is stainless steel.

While specific embodiments of the invention have been shown and described herein for purposes of illustration, the protection offered by any patent which may issue upon this application is not strictly limited to the disclosed embodiment; but rather extends to all structures and arrangements which fall fairly within the scope of the claims which are appended hereto.

What is claimed is:

1. A U-shaped packaging clip for securing end boards on a pallet, comprising:

a pair of receiving members connected to a middle support member having a first end edge and a second end edge, and together defining a U-shaped receiving channel;

said U-shaped receiving channel being adapted to receive and removably hold an end board; and end tabs at said first and said second end edges of said middle support member that engage an end board received within said U-shaped receiving channel;

whereby said end tabs create slots between said U-shaped receiving channel and an end board received therein by which to pry said U-shaped receiving channel free from an end board received therein without damaging said U-shaped receiving channel or an end board.

* * * * *